United States Patent [19]

Simmons

[11] Patent Number: 4,767,012

[45] Date of Patent: Aug. 30, 1988

[54] STRIP HANGER

[75] Inventor: Harry Simmons, Chatsworth, Calif.

[73] Assignee: Joseph Crowley, Northridge, Calif.

[21] Appl. No.: 10,330

[22] Filed: Feb. 3, 1987

Related U.S. Application Data

[63] Continuation-in-part of Ser. No. 854,871, Apr. 23, 1986.

[51] Int. Cl.[4] ..... A47F 7/00

[52] U.S. Cl. ..... 211/89; 211/71; 211/113; 248/221.4

[58] Field of Search ..... 211/89, 71, 113; 248/220.2, 221.4, 231.2, 316.5, 316.7

[56] References Cited

U.S. PATENT DOCUMENTS 4,573,590 3/1986 Ellis ..... 248/221.4 X

*Primary Examiner*—Robert W. Gibson, Jr.
*Attorney, Agent, or Firm*—David O'Reilly

[57] ABSTRACT

A merchandise hanger for supporting merchandise includes a base extending in a longitudinal direction. A lever extends in the longitudinal direction for supporting an article of merchandise wherein the lever has at least first and second flanged portions, the first flanged portion extending to the base from a mid-portion of the lever. The second flanged portion extends toward the base and is moveable away from the base. A mating portion is formed from the base for mating with the second flanged portion. The base and the lever are unitary. Preferably, the hanger is formed from the acetal.

9 Claims, 3 Drawing Sheets

STRIP HANGER

CROSS REFERENCE TO RELATED APPLICATIONS

This is a continuation-in-part of application Ser. No. 06/854,871, filed Apr. 23, 1986, entitled "Strip Hanger".

BACKGROUND OF THE INVENTION

1. Field of the Invention

This invention relates to spring strip hangers for supporting merchandise.

2. Related Art

Strip hangers such as those used for clipping and displaying potato chip bags and the like are typically formed from metal. A clip is mounted to a base strip through a bracketing strip. The potato chip bag is held by friction developed between an end of the clip and the surface of the base strip. The clip is mounted to the base through the bracket strip in such a way that force is applied through the end of the clip toward the base for holding the bag. The clip typically includes a second end on the side of the bracket strip opposite the first end. The second end may be used for raising the first end away from the base strip so that the bag may be inserted underneath the first end. The bag is held against the base strip when the second end is released.

In a second form of hanger, a hole is formed in the base strip directly beneath the first end of the clip. With the spring tension developed in the clip, the edge of the potato chip bag is forced into the hole by the end of the clip.

The metal strip hangers are costly to manufacture and typically require multiple pieces to form the final strip hanger. The metal required for making long-lasting strip hagners usually results in a relatively heavy strip hanger.

SUMMARY OF THE INVENTION

In the present invention, the merchandise hanger includes a base extending in a longitudinal direction. Means are formed from the base extending in the longitudinal direction for supporting an article of merchandise wherein the article supporting means comprises at least first and second flanged portions. The first flanged portion extends to the base from a mid-point of the article supporting means and the second flanged portion extends toward the base. The second flanged portion is moveable away from the base. The article supporting means further comprises means formed from the base for mating with the second flanged portion. The base and the article supporting means are unitary. In the preferred form, the hanger is formed from acetal, which has unique spring characteristics and memory characteristics. The acetal strip hanger is lightweight and is easily manufactured.

DETAILED DESCRIPTION

Figure 1:
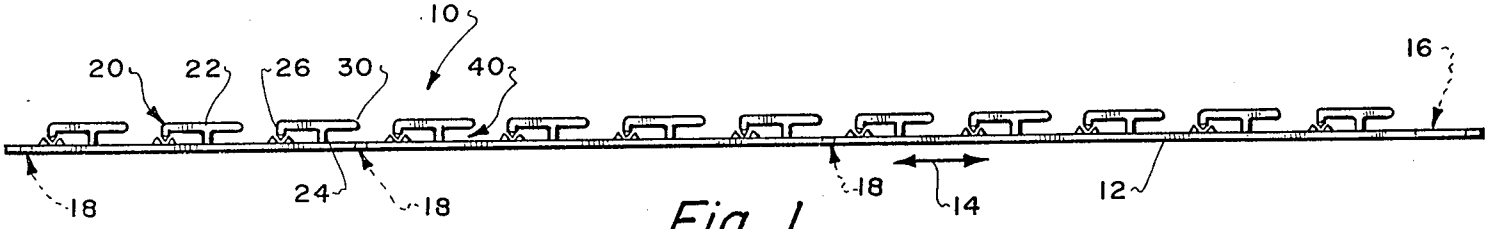
FIG. 1 is a side elevation view of a strip hanger embodying the present invention.

In the drawings, a merchandise hanger 10 is shown for supporting merchandise, such as potato chip bags and other snack foods. The hanger includes a base 12 extending in a longitudinal direction 14, the base preferably includes a quick-attachment hole 16 which may have a wide diameter suitable for accepting the head of a fastener or screw and a narrower portion narrower than the head of the fastener but wider than the shank of the fastener. The hole 16 is shown schematically at the right end of the hanger as seen in FIG. 1. Other securing holes 18 may be formed in the base for supporting the strip hanger.

Means in the form of a clip arrangement 20 is formed from the base and extends in the longitudinal direction for supporting an article of merchandise (not shown). The clip arrangement includes a lever 22 extending the longitudinal length of the clip arrangement. The clip arrangement includes a first flanged portion in the form of a pivot point or fulcrum 24 and a second flanged portion 26. The fulcrum extends to the base from a mid-portion of the lever and the second flanged portion extends toward the base and away from a first end 28 of the lever. The second flanged portion 26 is moveable away from the base. A lever operating end 30 is located at the end of the lever opposite the first end for moving the second flanged portion away from the base when a force directed toward the base is applied to the lever operating end.

The clip arrangement includes means in the form of ridges 32 formed from the base for mating with the second flanged portion. The ridges include sides 34 defining a groove 36 for mating with a point 38 formed in the end of the second flanged portion 26. The ridges and point form an interference fit for holding the merchandise.

In the preferred embodiment, the clip arrangement extends transversely only part way across the width of the hanger. Therefore, the width of the second flanged portion is narrower than that of the base. Additionally, the ridges and groove extend across the base less than the width thereof. Preferably, the point and the ridges are narrower than and are centered with respect to the second flanged portion. In the preferred embodiment, the clip arrangement is centered width- wise with respect to the base.

Each clip arrangement forms a recess 40 between the lever operating end and the fulcrum and the base. The recess may be used to hang packaged articles having holes or loops for looping over the lever operating end 30. The lever operating end 30 may be rounded to facilitate looping of the packages over the end. The loop or opening then rests in the recess so that the package hangs from the fulcrum.

In the preferred embodiment, there are 12 clip arrangements oriented on the base. The base is preferably 22½ inches in length and each clip arrangement is 1.150 inches. The distance between the lever operating end of one clip arrangement and the lever operating end of the next is 1.750 inches. The width of each clip arrangement is 5/16 of an inch. The peak-to-peak distance between the ridges 32 is 0.100 inch. The height of the ridges 32 is approximately 1/16 of an inch and the width of the groove is also approximately 1/16 of an inch. The width of the ridges is approximately ⅛ inch.

The distance between the lever operating end 30 and the center line of the fulcrum is 0.550 inch. The distance from the center line of the fulcrum to the center line of the second flanged portion, and therefore the point 38, is 0.600 inch. The thickness of the base is 0.100 inch and the distance from the top surface of the clip arrangement to the bottom surface of the base is 0.312 inch. The width of the base is 0.750 inch and the diameter of the large portion of the quick-attachment hole is ⅜ of an inch and the diameter of the small portion is 0.260 inch. The distance between the center of the large portion and the center of the small portion is 0.350 inch.

The hanger is made from acetal which is preferred due to its strength and durability and spring-like nature. The acetal has memory characteristics which return the clip arrangement to its original configuration after the lever operating end is released.

Figure 3:
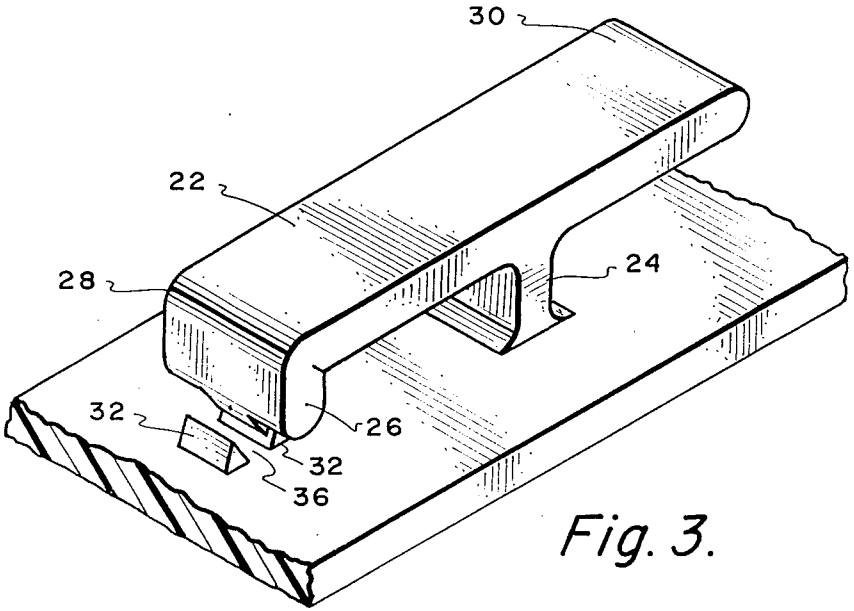
FIG. 3 is a perspective view of the strip hanger shown in FIG. 2.
Figure 2:
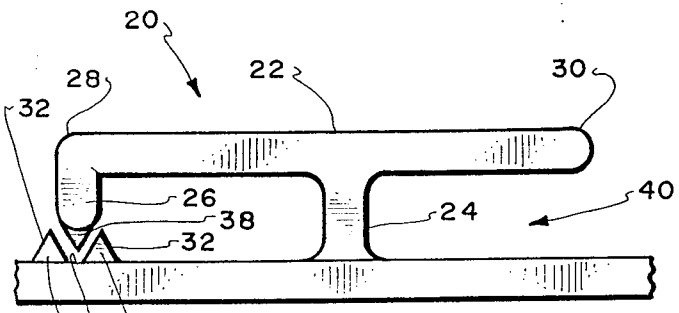
FIG. 2 is a side elevation view of one portion of the strip hanger of claim 1.
Figure 4:
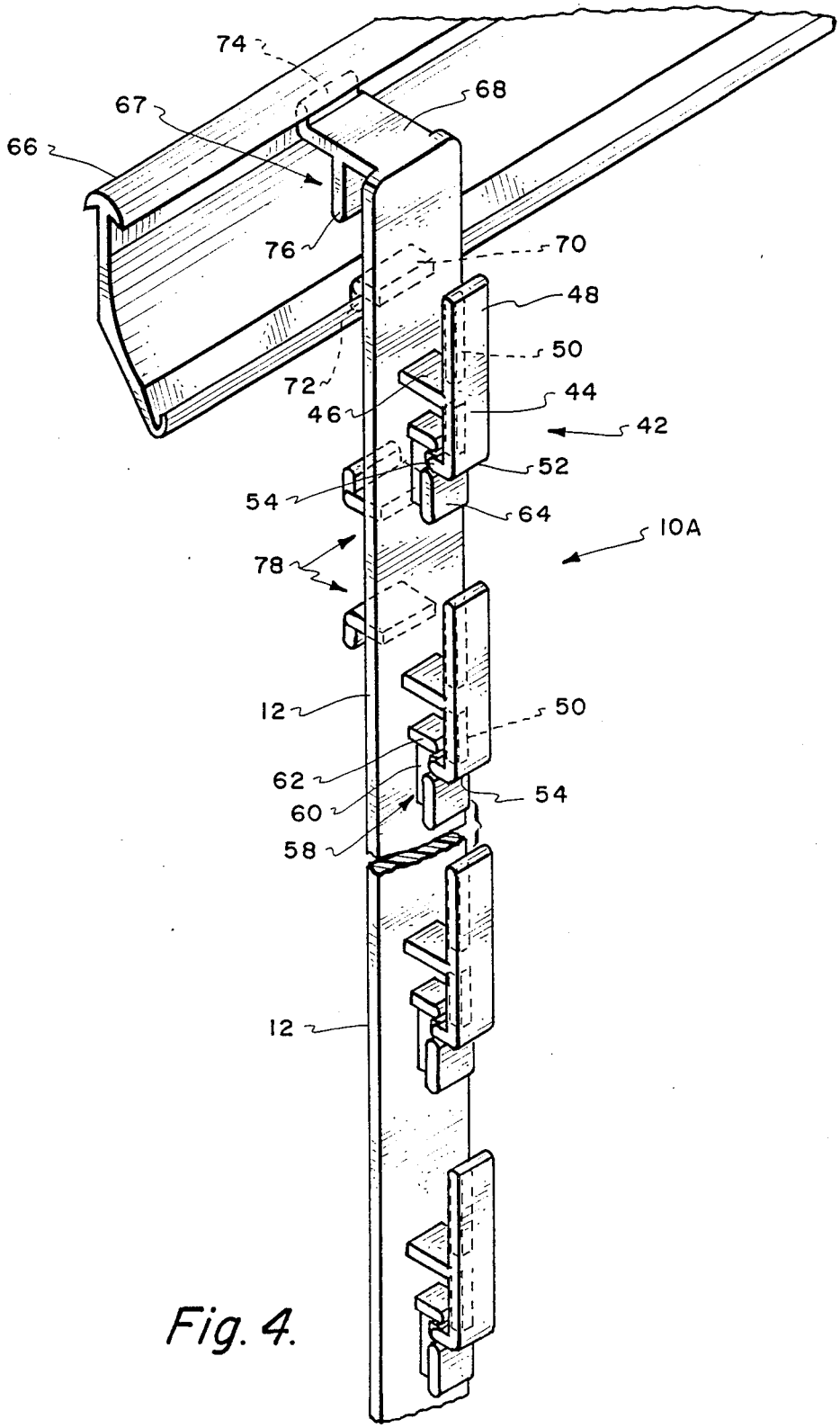
FIG. 4 is a side perspective view of an additional embodiment of a strip hanger according to the present invention suspended from a price strip.
Figure 5:
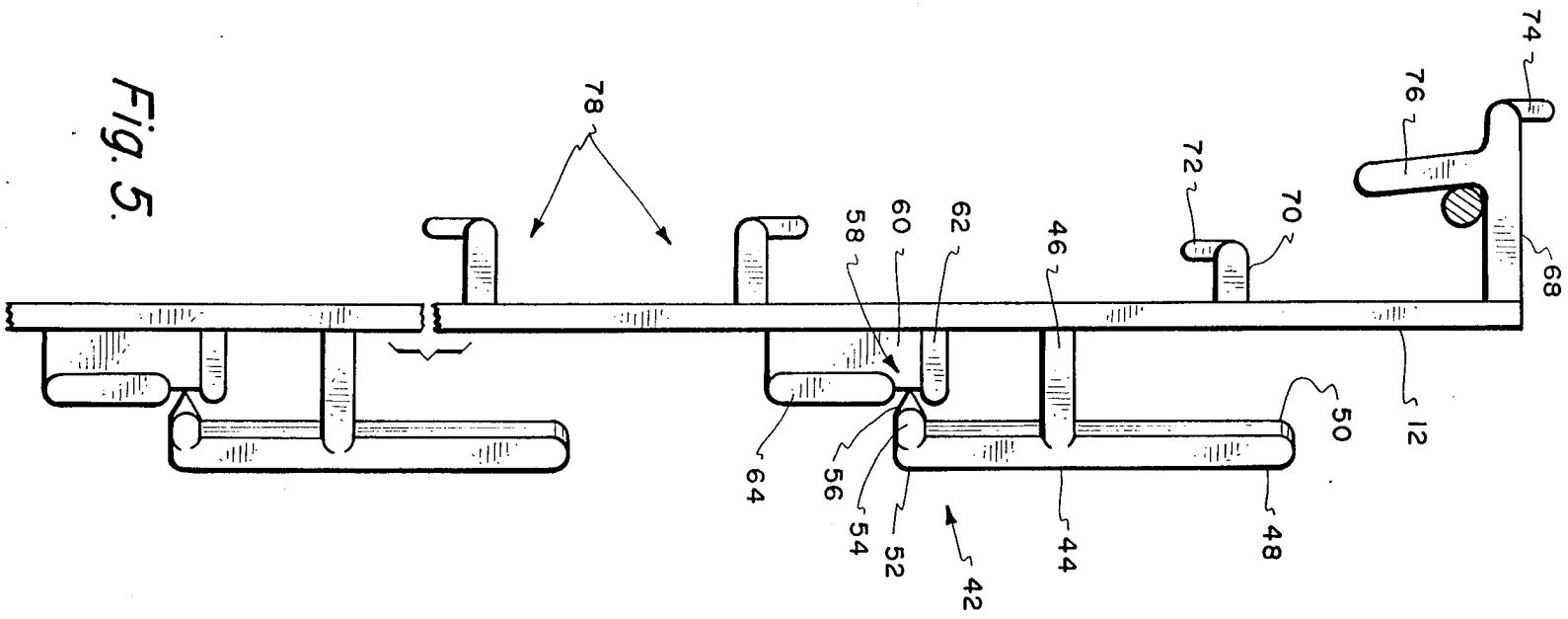
FIG. 5 is a side elevation view of the strip hanger of FIG. 4.

FIGS. 4 and 5 show a further embodiment of a strip hanger 10A according to the present invention. The strip hanger includes a base 12 extending in a longitudinal direction and a plurality of clip assemblies 42 for supporting articles of merchandise, such as potato chip bags. Each clip assembly includes a lever 44 for operating the clip assembly. The lever is formed from the base through a first flanged portion 46 extending perpendicularly from the surface of the base to an underside of the lever. The lever is formed perpendicular to the first flanged portion 46. The first flanged portion operates as a fulcrum for the lever. The lever 44 is formed 0.100 inch higher from the base than the clip assembly described with respect to FIGS. 1–3.

The lever includes a lever operating end 48 freely moveable about the fulcrum when a force is applied toward the base to the lever operating end. A rib 50 extends longitudinally along the underside of the lever to provide added strength to the lever.

The lever extends from the lever operating end past the fulcrum point to the first end 52 of the lever. The first end moves about the fulcrum in response to movement of the operating end 48. The first end includes a second flanged portion in the form of a head 54 extending downward toward the base 12 and perpendicular to the lever 44 and to the base 12. The head includes a point or tip 56 having a shorter width and smaller cross sectional area than the head 54.

The head interacts with an anvil 58 extending upwardly and formed from the base 12. The anvil includes a base ridge 60 extending upwardly and longitudinally with respect to the base. The base ridge forms a recess with an interference plate 62 extending upwardly and transversely from the base. The interference plate is formed integral with the base 12. An interference engagement is formed with a bag of merchandise (not shown) when the head on the lever 44 approaches the base ridge 60 and interference plate 62 as the lever operating end 48 is released. The resilient and flexible nature of the clip assembly allows the lever and head to return to a position where the lever is parallel to the base 12. When a bag of merchandise is placed between the base ridge and interference plate and the head, the bag material is frictionally engaged therebetween by the interference fit.

A planar guide bench 64 extends longitudinally with respect to the base 12 and perpendicular to the base ridge 60. The guide bench extends laterally on each side of the base ridge over a portion of the length of the base ridge. The end of the guide bench adjacent the head contributes to forming the recess for accepting the head 54. The guide bench serves to guide the leading edge of the merchandise bag into the recess to allow the interference engagement between the merchandise bag and the clip assembly.

The strip hanger includes a pair, and preferably two pair, of interlock flanges, each alternatively for engaging a price strip 66, and from which the strip hanger is suspended. Both pairs of interlock flanges extend perpendicular from the base 12 in a direction transverse to the longitudinal dimension of the base. A first pair of interlock flanges 67 include an upper flange 68 and a lower flange 70. The lower flange includes an interlock tab 72 at the free end of the lower flange extending downwardly with respect to the lower flange. The upper flange has a similar interlock tab 74 extending upwardly. The interlock tabs engage grooves in the price strip 66 for suspending the strip hanger in a fixed position. The price strip is mounted to a wall or other support as is known in the art. The upper flange 68 also has a hook 76 extending in a direction parallel to the interlock tab 72 on the lower flange for hooking over an edge, rod or wire to suspend the strip hanger when a price strip is not available. The hook 76 is located on the upper flange further from the base 12 than the interlock tab 72 so that the strip hanger is easily suspended from the edge or rod. The interlock tab 74 on the upper flange extends a distance further from the base 12 than the interlock tab 72. This allows the strip hanger to be mounted on a price strip which is angled from the support on which the price strip is mounted. A second pair of interlock flanges 78 extend an equal distance with respect to each other from the base 12 so that the strip hanger can be mounted on and supported by a price strip which is parallel to or flush with its support.

The strip hanger is mounted to an appropriate price strip by moving the strip hanger through an arc so that diagonally opposite edges of the interlock tabs engage the grooves in the price strip. The strip hanger is then moved arcuately in the opposite direction until the strip hanger extends in a direction perpendicular to the direction in which the price strip extends. Articles of merchandise are then mounted to the strip hanger through respective clip assemblies by passing the edge of the merchandise over the guide bench 64 while raising the head on the lever 44. The edge of the merchandise is slipped underneath the head and against the interference plate 62. The lever operating end 48 is released so that the head engages the merchandise in the recess formed by the interference plate, the base ridge, and the guide bench. The merchandise is removed by pulling it out of engagement with the clip assembly. If the merchandise has a hole in an edge for hanging the merchandise, the hole can be placed around the lever operating end 48.

The strip hanger is formed from a mold as is well-known in the art of manufacturing articles from organic materials. Therefore, the strip hanger is preferably one piece, the base and the clips are being integral.

It should be noted that the above are preferred configurations, but others are foreseeable. The described embodiments of the invention are only considered to be preferred and illustrative of the inventive concept. The scope of the invention is not to be restricted to such embodiment. Various and numerous other arrangements may be devised by one skilled in the art without departing from the spirit and scope of the invention.

What is claimed is:

1. A merchandise package strip hanger comprising:

an elongate strip base;

a plurality of clips spaced along a surface of said base;

said clips comprising a lever means having an operating end and a clamping end, said clamping end having a flange extending toward and being in opposition to the surface of said base;

fulcrum means attaching said lever means to said elongate base so that a downward force on said operating end of said lever means displaces said flanges end of said lever means away from said surface of said base;

said elongate strip base, said lever means and said fulcrum means being constructed of a synthetic material forming a homogeneous integral construction;

hanger means on an end of said elongate strip base for hanging said clip means with said clamping end downward;

whereby a plurality of packages of merchanise can be displayed by hanging from said plurality of clip means on elongate strip base.

2. The hanger according to claim 1 in which said homogeneous synthetic material is acetal.

3. The hanger according to claim 1 including means forming a recess on said base; said flange end on said lever clamping end having a pointed tip engaging said recess for providing a positive clamping action on packages inserted in the clamping end of said clip means.

4. The hanger according to claim 3 in which said means forming a recess comprises a pair of spaced apart ridges integrally formed on said elongate strip base.

5. The hanger according to claim 4 in which said pointed tip on said lever clamping end flange abuts the surface of said elongate strip base between said pair of spaced apart ridges thereby forming an inteference fit to secure merchandise packages.

6. The hanger according to claim 1 in which said hanger means includes a pair of interlocking tab means integrally formed on the surface of said elongate strip base opposite said clip means; said interlocking tab means constructed and arranged to fit into channels in a display shelf price tag mounting strip, whereby said package hanging strip may be mounted in said price tag mounting strip.

7. The hanger according to claim 6 including means forming a recess on said base; said flange end on said lever clamping end having a pointed tip engaging said recess for providing a positive clamping action on packages inserted in the clamping end of said lever.

8. The hanger according to claim 7 in which said means forming a recess comprises; a longitudinal base ridge; said flanged end of said lever clamping end abutting said base ridge; an interference plate on an end of said base ridge adjacent said flange end; and a planar guide bench on said base ridge opposite said interference plate.

9. The hanger according to claim 8 in which said pair of interlocking tab means comprises an upper tab and a lower tab; said upper tab having a downwardly projecting flange forming a hook, whereby said package hanging strip can be easily hung from a rod.

* * * * *